US008910583B2

(12) United States Patent
Matsushima et al.

(10) Patent No.: US 8,910,583 B2
(45) Date of Patent: Dec. 16, 2014

(54) METHOD OF SEWING FASTENER STRINGER AND METHOD OF MANUFACTURING PRODUCT TO WHICH FASTENER IS ATTACHED

(75) Inventors: Haruo Matsushima, Toyama (JP); Koji Ito, Toyama (JP); Tetsuya Yoshino, Toyama (JP); Seiji Koga, Toyama (JP)

(73) Assignee: YKK Corporation (JP)

( * ) Notice: Subject to any disclaimer, the term of this patent is extended or adjusted under 35 U.S.C. 154(b) by 168 days.

(21) Appl. No.: 13/515,357

(22) PCT Filed: Dec. 24, 2009

(86) PCT No.: PCT/JP2009/071487

§ 371 (c)(1),
(2), (4) Date: Jun. 12, 2012

(87) PCT Pub. No.: WO2011/077534

PCT Pub. Date: Jun. 30, 2011

(65) Prior Publication Data

US 2012/0246888 A1 Oct. 4, 2012

(51) Int. Cl.

| | |
|---|---|
| ***D05B 1/00*** | (2006.01) |
| ***A44B 19/42*** | (2006.01) |
| ***A44B 19/12*** | (2006.01) |
| ***D05B 35/06*** | (2006.01) |
| ***A44B 19/40*** | (2006.01) |
| ***A44B 19/14*** | (2006.01) |

(52) U.S. Cl.

CPC ..... *D05B 35/064* (2013.01); *A44B 19/42* (2013.01); *A44B 19/12* (2013.01); *A44B 19/406* (2013.01); *A44B 19/14* (2013.01)

USPC ..... 112/475.04

(58) Field of Classification Search

USPC ..... 112/475.01, 475.03, 475.04, 475.06, 112/475.08, 475.16, 475.21

See application file for complete search history.

(56) References Cited

U.S. PATENT DOCUMENTS 2,576,324 A * 11/1951 Wirt ..... 112/419
4,321,880 A * 3/1982 Boser ..... 112/127

(Continued)

FOREIGN PATENT DOCUMENTS

CN 1805697 A 7/2006
CN 101535548 A 9/2009

(Continued)

OTHER PUBLICATIONS

International Search Report and Written Opinion, PCT International Application No. PCT/JP2009/071487, mailed Apr. 6, 2010.

(Continued)

*Primary Examiner* — Tejash Patel

(74) *Attorney, Agent, or Firm* — Kilpatrick Townsend & Stockton LLP

(57) ABSTRACT

A fastener attached product is structured such that a slide fastener is sewn to right and left attached bodies which are bent in a U-shape, and the right and left attached bodies are arranged in a tape surface side to which the element rows of the fastener tape are sewn. Further, the right and left attached bodies come into contact with the outer surfaces of right and left flanges which are arranged in a slider, and the element rows are arranged and exposed between the right and left attached bodies. As a result of this configuration, since the fastener tape is invisible from the outside by the attached body, exposing the element rows can provide the fastener attached product with different design from conventional products and eliminate problems due to degradation in the appearance and design which is caused by the exposure of the fastener tapes.

6 Claims, 7 Drawing Sheets

(56) References Cited

U.S. PATENT DOCUMENTS

| | | | | |
|---|---|---|---|---|
| 6,792,883 | B2 * | 9/2004 | Ashton | 112/475.01 |
| 7,448,643 | B2 * | 11/2008 | Kuettner et al. | 280/728.3 |
| 2006/0290497 | A1 | 12/2006 | Sugata | |

FOREIGN PATENT DOCUMENTS

| | | | |
|---|---|---|---|
| EP | 1661478 | A1 | 5/2006 |
| EP | 2078774 | A1 | 7/2009 |
| JP | 51-95459 | | 7/1976 |
| JP | 9-313219 | A | 12/1997 |
| JP | 2006-015069 | | 1/2006 |
| JP | 2006-247279 | | 9/2006 |
| JP | 3152100 | | 6/2009 |
| WO | 2005/018365 | A1 | 3/2005 |
| WO | 2008/053558 | A1 | 5/2008 |

OTHER PUBLICATIONS

International Search Report and Written Opinion, PCT International Application No. PCT/JP2009/071561, mailed Apr. 13, 2010.

* cited by examiner

METHOD OF SEWING FASTENER STRINGER AND METHOD OF MANUFACTURING PRODUCT TO WHICH FASTENER IS ATTACHED

This application is a national stage application of PCT/JP2009/071487 which is incorporated herein by reference.

TECHNICAL FIELD

The invention relates to a sewing method for sewing a fastener stringer to an attached body, a manufacturing method for manufacturing a product to which a fastener is attached from the attached body to which the fastener stringer is sewed by the sewing method, a product to which the fastener is attached which is obtained by the manufacturing method, and a sewing machine foot used in the sewing method.

BACKGROUND ART

Conventionally, in the case of sewing a fastener stringer or a fastener chain to which a coil-shaped continuous element made of a synthetic resin is sewn to various attached bodies such as a cloth and the like, a sewing process has been carried out by using a sewing machine having a sewing machine foot, for example, as disclosed in Japanese Utility Model Publication No. 51-95459 (Patent Document 1).

In this case, a description will be given briefly of a method of sewing a fastener chain to which a continuous element is sewn to an attached body by using a sewing machine foot which is disclosed in the Patent Document 1.

First of all, as shown in FIG. 10, a fastener chain 51 is arranged in such a manner that a continuous element 52 is arranged in an upper side of a fastener tape 53, and an attached body 54 is further superposed in a state of being bent in a U-shape, on the fastener tape 53 of the fastener chain 51. At this time, the continuous element 52 and the U-shaped bent attached body 54 are arranged in the same tape surface side of the fastener tape 53.

In a state in which the attached body 54 is superposed on the fastener tape 53 of the fastener chain 51 as mentioned above, the fastener tape 53 and the attached body 54 are conveyed between a sewing machine head 55 of a sewing machine and a throat plate which is not illustrated. Further, the fastener tape 53 and the attached body 54 are thrust by a sewing machine needle 56 so as to be sewn to each other while pressing the fastener tape 53 and the attached body 54 by the sewing machine foot 55, whereby the fastener chain 51 can be sewn to the attached body 54.

In the case that the fastener chain 51 is sewn to the attached body 54 as mentioned above, it is demanded to make a bent section 54*a* of the attached body 54, which is bent in a U-shape, close to the continuous element 52 of the fastener chain 51 and accurately carry out a sewing while forming a sewing line (a stitch line) sewing the fastener tape 53 to the attached body 54 substantially in parallel to the continuous element 52, for example, in order to enhance an outer appearance quality of a product to which the fastener is attached. On the other hand, since a thrusting position of the sewing machine needle 56 and the vicinity thereof are concealed by the sewing machine foot 55 in the case that the sewing is carried out by the sewing machine, it has been hard to accurately carry out the sewing as mentioned above.

Accordingly, in the Patent Document 1, the sewing machine foot 55 installed to the sewing machine is constructed by using a transparent material (for example, a transparent synthetic resin material). In accordance with this, it is possible to easily view the thrusting portion of the sewing machine needle 56 and the vicinity thereof via the transparent sewing machine foot 55 at a time of sewing. In accordance with this, it is possible to make the U-shaped bent section 54*a* of the attached body 54 close to the continuous element 52, and it is possible to accurately carry out the sewing in such a manner that the sewing line is arranged substantially in parallel to the continuous element 52.

Even in this case, it is necessary for the sewing machine foot 55 to stably press the fastener tape 53 and the attached body 54 from the above at a time of sewing, and it is necessary that the sewing machine foot 55 itself has a predetermined strength. Accordingly, it has been necessary for the sewing machine foot 55 to be formed in such a manner that a dimension in a width direction (a lateral direction) is secured at a predetermined size or more. In accordance with this, it is necessary for the sewing line to be set at a position which is spaced at a predetermined distance from the continuous element 52, in such a manner as to prevent the sewing machine foot 55 and the continuous element 52 from being interfered at a time of sewing, and there has been a limit to make the U-shaped bent section 54*a* of the attached body 54 close to the continuous element 52.

In this case, in the slide fastener having the continuous element 52 as shown in FIG. 10, the continuous element 52 is arranged in an outer surface (an exposed surface) side of the fastener attached product, at a time when it is attached to the attached body 54, the continuous element 52 comes to a state in which it is exposed to an external portion in an ordinary manner of use.

However, in recent years, the slide fastener has come to be widely used, for example, in a sitting seat for a motor vehicle and the like, as well as the clothes. In accordance with this, in some product to which the slide fastener is attached, there has been a case that it is desirable to conceal the continuous element in such a manner as to be prevented from being exposed to the external portion, in the light of a design or the like.

In order to respond to the demand mentioned above, there has been known a slide fastener of a concealed type (a concealed slide fastener) which can shield the continuous element by the fastener tape so as to be invisible from an outer surface side (refer, for example, to Japanese Patent Application Laid-Open No. 2006-015069 (Patent Document 2) and the like).

Typically, the concealed slide fastener has a pair of right and left fastener tapes, coil-shaped or zigzag-shaped continuous elements which are respectively sewn to the fastener tapes, and sliders which are arranged so as to be slidable along the right and left continuous elements. In this case, the fastener tape has a tape main body portion and an element attaching portion which is arranged in a side of one side edge of the tape main body portion, and the tape main body portion in a side of the element attaching portion is bent in a U-shape in a tape width direction, whereby a bent section is formed.

The continuous element has an engagement head, upper and lower leg portions which are extended from the engagement head, and a connecting portion (which is also called as a reverse portion) which connects between leg portions of the elements which are adjacent to each other. The continuous element is attached by sewing the upper and lower leg portions to an element attaching portion of the fastener tape, in a state in which the engagement head is directed to the side of the tape main body portion of the fastener tape. In accordance with this, since the fastener tape is bent in a U-shape as mentioned above, it comes to a state in which the engagement head of the continuous element protrudes toward an outer side from the U-shaped bent section of the fastener tape.

In accordance with the concealed slide fastener mentioned above, the U-shaped bent sections of the right and left fastener tapes are confronted to each other by sliding the slider so as to engage the right and left continuous elements with each other. In accordance with this, the right and left continuous elements in the engaged state can be concealed in such a manner as to be invisible from the tape exposure surface side of the fastener tape, by the fastener tape in which the bent sections thereof are confronted to each other.

Accordingly, the concealed slide fastener is preferably used in the product such as the various clothes, shoes and the like, by taking advantage of not precluding a design of the product with its concealment, and has further come to be used in a seat cover for a sitting seat of a motor vehicle, a train and the like, in recent years.

PRIOR ART DOCUMENT

Patent Document

Patent Document 1: Japanese Unexamined Utility Model Publication No. 51-95459

Patent Document 2: Japanese Unexamined Patent Publication No. 2006-015069

SUMMARY OF THE INVENTION

Problems to be Solved by the Invention

Conventionally, in the case that the slide fastener is used in the product to which it is attached such as the seat cover of the motor vehicle or the like, it has been general to use the concealed slide fastener as mentioned above which makes the continuous element in the engaged state invisible from the outside, for preventing the continuous element from affecting the design of the product.

On the other hand, since the element which is used in the slide fastener and is made of the synthetic resin can give various colors, it is possible to easily change a color of the element in correspondence to a design or the like of the product to which the slide fastener is attached. Accordingly, attempts to provide the attached product with a new design have begun to be made by making the continuous element of the slide fastener positively exposed to the outside with respect to the product such as the seat cover or the like in which the concealed slide fastener has been frequently used in recent years.

However, in the case that the fastener attached product such as the seat cover or the like is constructed by making the continuous element positively exposed, it is necessary to make a sewing line which sews the fastener tape 53 to the attached body 54 be spaced at a predetermined distance from the continuous element 52, as mentioned above at a time of sewing the slide fastener having the continuous element to the attached body by using the conventional sewing method, for example, as described in the Patent Document 1. Hence, it has been impossible to make the U-shaped bent section 54*a* of the attached body 54 close to the continuous element 52.

In accordance with this, in the case that the slide fastener is sewn to the attached body 54 in such a manner as to make the continuous element 52 exposed to the outside, the fastener attached product, which is obtained after sewing, is structured such that not only the continuous element 52 is exposed to the outside, but also the fastener tape 53 is necessarily exposed to the outside.

If the fastener tape 53 of the slide fastener is exposed to the outside as well as the continuous element 52 as mentioned above, the right and left attached bodies to which the slide fastener is attached are spaced widely from each other, and a step is formed between the attached body and the fastener tape. Therefore, even if it is intended to provide the fastener attached product with a new design by positively exposing the continuous element 52, there will be such problems that an appearance of the fastener attached product becomes poor, and that the design thereof is degraded.

On the other hand, if the sewing of the fastener tape and the attached body is performed so as not to expose the fastener tape as much as possible, for example, the sewing line is positioned in the vicinity of the continuous element, the sewing machine foot and the continuous element are interfered with each other at a time of sewing, and there has been such a problem that the fastener stringer cannot be stably sewn to the attached body.

The invention is made by taking the conventional problem mentioned above into consideration, and a specific object thereof is to provide a method of sewing a fastener stringer which can sew a fastener stringer to an attached body by concealing a fastener tape so as not to be exposed at the same time of exposing element rows, a manufacturing method for manufacturing a product to which a fastener is attached from an attached body to which the fastener stringer is sewn by the sewing method, a product to which the fastener is attached, which can be obtained by the manufacturing method, and a sewing machine foot which is used in the sewing method.

Means for Solving the Problems

In order to achieve the object mentioned above, a method of sewing a fastener stringer provided by the invention is a method of sewing a fastener stringer which, as a basic structure, has a fastener tape in which a tape surface is arranged on the same plane, and element rows which are attached to a tape side edge portion of the fastener tape, and in which an engagement head in the element rows protrudes out of a tape end edge of the fastener tape, to an attached body by using a sewing machine. The sewing machine has a sewing machine foot which is provided with an element guide groove capable of inserting the element rows and a part of the fastener tape, and the method is most mainly characterized in including the steps of conveying the fastener stringer and the attached body toward the sewing machine foot in a state of aligning a tape surface in a side to which the element rows of the fastener tape are attached, with one surface corresponding to a side which is exposed to an external portion of the attached body so as to superpose the fastener stringer on the attached body, at a time of sewing the fastener stringer, guiding the element rows to the element guide groove of the sewing machine foot while bending the fastener tape in such a manner that the engagement head of the element rows rises, and sewing the fastener tape to the attached body while inserting the element rows and a part of the fastener tape in to the element guide groove of the sewing machine foot.

In this case, it is preferable that the method of sewing the fastener stringer in accordance with the invention includes using a fastener stringer sewn to one surface of the fastener tape in which the element rows are coil-shaped or zigzag-shaped continuous elements, as the fastener stringer.

Further, it is preferable that the method of sewing the fastener stringer in accordance with the invention includes setting a distance in a width direction from a center axis in a sewing machine needle of the sewing machine to a position of a bent base end of the fastener tape to be equal to or less than 1.2 mm, at a time when the element rows travel within the element guide groove of the sewing machine foot.

Further, in the sewing method of the invention, it is preferable that the element guide groove is inclined at a predetermined angle with respect to a bottom surface corresponding to a pressing surface of the sewing machine foot, and is arranged along a direction of conveying the fastener stringer, and a bending angle of the fastener tape with respect to the bottom surface of the sewing machine foot is set to be equal to or more than 65 degrees and equal to or less than 80 degrees at a time when the element rows travel within the element guide groove of the sewing machine foot.

Further, a method of manufacturing a fastener attached product which is provided by the invention is most mainly characterized by including at least bending the attached body to which the fastener stringer is sewn by the method of sewing the fastener stringer having the structure mentioned above in a U-shape toward an opposite side to the fastener stringer side along a sewing line, and constructing a slide fastener by attaching a slider to a pair of right and left fastener stringers, thereby manufacturing the fastener attached product in which the slide fastener is, attached to the attached body.

Further, in accordance with the invention, it is possible to provide the fastener attached product which is manufactured by the method of manufacturing the fastener attached product having the structure mentioned above.

Further, the fastener attached product which is provided by the invention is a product to which a fastener is attached, structured, as a basic structure, such that slide fasteners are sewn to right and left attached bodies which are bent in a U-shape, the slide fasteners having right and left fastener stringers in which element rows are attached to opposed tape side edge portions of a pair of right and left fastener tapes in which tape surfaces are arranged on the same plane, and a slider which is attached so as to be slidable along the element rows, the element rows in at least one of the right and left fastener stringers are arranged in a state in which engagement heads thereof are protruded from a tape end edge of the fastener tape, and the right and left attached bodies are arranged in a tape surface side to which the element rows of the fastener tape are attached, most mainly characterized in that the right and left attached bodies come into contact with outer surfaces of right and left flanges which are arranged in the slider, and the element rows are arranged and exposed between the right and left attached bodies.

In the fastener attached product in accordance with the invention, it is preferable that the element rows are coil-shaped or zigzag-shaped continuous elements, and are sewn to one surface of the fastener tape.

Further, in the fastener attached product of the invention, it is preferable that the attached body has a fastener attaching portion to which the slide fastener is sewn, a bent section which extends in a width direction from the fastener attaching portion and is bent in a U-shape, and a main body portion which extends in a width direction from the bent section and is exposed to an external portion in its one surface, and the slide fastener is sewn only to the fastener attaching portion of the attached body.

Further, in the fastener attached product of the invention, it is preferable that right and left sewing lines sewing the attached body and the fastener tape are arranged in outer sides of the right and left flanges of the slider.

In this case, it is preferable that a distance between the sewing lines and the element rows is set to be equal to or more than 0.2 mm and equal to or less than 1.6 mm. Further, it is preferable that a distance between the sewing lines and the flanges is set to be equal to or more than 0.1 mm and equal to or less than 1.0 mm.

Next, a sewing machine foot provided by the invention is a sewing machine foot having a fastener tape, and element rows which are attached to a tape side edge portion of the fastener tape, as a basic structure, and used in a sewing machine which sews a fastener stringer in which an engagement head in the element rows protrudes out of the tape end edge of the fastener tape, to a sheet-like attached body, most mainly characterized in that an element guide groove capable of inserting the element rows is formed along a direction in which the fastener stringer is conveyed by the sewing machine, the element guide groove is arranged so as to be inclined at a predetermined angle with respect to a pressing surface which presses the fastener tape, and an inner wall surface of the element guide groove has a support portion which supports the element rows traveling within the element guide groove from a side of at least one of an engagement head and an upper leg portion.

Further, in the sewing machine foot in accordance with the invention, it is preferable that the sewing machine foot is structured such that a distance in a width direction from a center axis in a sewing machine needle of the sewing machine to an inner wall surface of the element guide groove is set to be equal to or less than 1.2 mm, at a time of being installed to the sewing machine.

Effect of the Invention

In the method of sewing the fastener stringer of the invention, the fastener stringer is sewn to the attached body by using the sewing machine having the sewing machine foot which is provided with the predetermined element guide groove capable of inserting the element rows and a part of the fastener tape. Further, at a time of carrying out the sewing of the fastener stringer, at least the following steps are carried out.

Specifically, first of all, the fastener stringer is superposed on the attached body by aligning the tape surface in the side to which the element rows of the fastener tape are attached, with the one surface to be the side which is exposed to the external portion of the attached body, and the fastener stringer and the attached body are conveyed toward the sewing machine foot, in a state in which the element rows are arranged between the fastener, tape and the attached body.

Subsequently, the element rows are guided to the element guide groove of the sewing machine foot while bending the fastener tape to the opposite side (the upward side) to the attached body side in such a manner that the engagement head of the element rows arises. Thereafter, the fastener tape is sewn to the attached body at a position which is in the vicinity of the element rows, while inserting the element rows and a part of the fastener tape to the element guide groove of the sewing machine foot.

In accordance with the sewing method of the invention for sewing the fastener stringer to the attached body in the manner mentioned above, it is possible to make the element rows of the fastener stringer and the U-shaped bent section of the attached body close or in contact with each other, at a time of bending the attached body in a U-shape after sewing the fastener stringer to the attached body. In accordance with this, the element rows are exposed to the outer surface (the exposed surface) side, and it is possible to easily obtain the attached body with the fastener stringer which makes the fastener tape hard to be viewed or invisible between the element rows and the U-shaped bent section of the attached body.

In this case, since the element rows in the invention are formed as the continuous elements (for example, the coil elements or the zigzag elements), and the element rows are sewn to one surface of the fastener tape, the element rows are visible so as to be elevated largely from the tape surface, the fastener tape is hard to be viewed from between the elements, and it is possible to obtain the fastener stringer having a good appearance.

In the sewing method in accordance with the invention mentioned above, the distance in the width direction from the center axis in the sewing machine needle of the sewing machine to the bending base end position of the fastener tape can be set at equal to or less than 1.2 mm, preferably equal to or more than 0.2 mm and equal to or less than 1.2 mm, at a time when the element rows travel within the element guide groove of the sewing machine foot.

It is possible to smoothly thrust the sewing machine needle to the fastener tape and the attached body by setting the distance in the width direction mentioned above to be equal to or more than 0.2 mm. In accordance with this, it is possible to stably sew the fastener stringer to the attached body while preventing any trouble from being generated in a tightness of stitches of the sewing thread at a time of sewing the fastener stringer to the attached body, and it is possible to prevent the sewing thread from being damaged by coming into contact with the element rows at a time when the sewing needle is thrust.

Further, it is possible to easily insert the flange of the slider between the element rows of the fastener stringer and the U-shaped bent section of the attached body at a time of constructing the slide fastener, by setting the distance in the width direction mentioned above to be equal to or more than 0.2 mm. In accordance with this, it is possible to inhibit the sliding performance of the slider from being lowered, by making the element rows of the fastener stringer and the U-shaped bent section of the attached body close to or in contact with each other.

On the other hand, since it is possible to make the dimension between the element rows of the fastener stringer and the U-shaped bent section of the attached body small by setting the distance in the width direction mentioned above to be equal to or less than 1.2 mm, it is possible to make the fastener tape hard to be viewed from between the element rows and the U-shaped bent section of the attached body. Further, it is possible to make it hard for a puckering to be generated in the attached body to which the fastener stringer is sewn, by setting the distance in the width direction mentioned above to be equal to or less than 1.2 mm.

In this case, the puckering is such a phenomenon that a wavy wrinkle is generated in the attached body and the fastener tape, since the tension of the sewing thread sewing the fastener stringer to the attached body is strong and the attached body is strongly tightened at a portion of the sewing line and contracts in the length direction.

In the invention, it is possible to arrange the sewing line which sews the fastener stringer to the attached body in the vicinity of the element rows by setting the distance in the width direction mentioned above to be equal to or less than 1.2 mm. In accordance with this, even if the attached body is strongly tightened at the portion of the sewing line, it is possible to inhibit the attached body from contracting in the length direction by utilizing a rigidity of the element rows. Accordingly, as mentioned above, it is possible to make it hard for the puckering to be generated in the fastener stringer and the attached body.

Further, in the sewing method in accordance with the invention, the element guide groove of the sewing machine foot is inclined at a predetermined angle with respect to the bottom surface of the sewing machine foot, and is arranged along a direction of conveying the fastener stringer. In this case, the bending angle of the fastener tape with respect to the bottom surface of the sewing machine foot can be set at equal to or more than 65 degrees and equal to or less than 80 degrees, at a time when the element rows travel within the element guide groove of the sewing machine foot. By setting the bending angle of the fastener tape in the range mentioned above, it is possible to smoothly thrust the sewing machine needle to the fastener tape and the attached body so as to stably sew the fastener tape to the attached body at a position in the vicinity of the element rows.

Next, in the method of manufacturing the fastener attached product which is provided by the invention, the attached body to which the fastener stringer is sewn by the method of sewing the fastener stringer mentioned above is bent in a U-shape toward an opposite side to the fastener stringer side along the sewing line. Further, the fastener attached product is manufactured by attaching the slider to a pair of right and left fastener stringers so as to construct the slide fastener.

In the method of manufacturing the fastener attached product in accordance with the invention mentioned above, since the element rows of the fastener stringer are exposed between the U-shaped bent sections of the right and left attached bodies, and the element rows of the fastener stringer and the U-shaped bent section of the attached body come close to or into contact with each other, it is possible to easily and stably manufacture the fastener attached product in which the fastener tape is hard to be viewed or invisible.

Further, in the fastener attached product of the invention which is manufactured by the method of manufacturing the fastener attached product as mentioned above, the element rows are exposed between the U-shaped bent sections of the right and left attached bodies, and the fastener tape is arranged in such a manner as to be hard to be viewed from the external portion (the exposed surface side) or invisible by the attached body. As a result of this configuration, positively exposing the element rows to the outside can provide the fastener attached product with a new design and easily eliminate conventional problems that the appearance of the attached product becomes poor or the design is degraded, which are caused by the exposure of the fastener tapes.

Further, the fastener attached product in accordance with the invention is structured such that the slide fastener is sewn to the U-shaped bent right and left attached bodies. Further, the right and left attached bodies in the fastener attached product come, into contact with the outer surfaces of the right and left flanges which are arranged in the slider, and the element rows are arranged and exposed between the right and left attached bodies.

In the fastener attached product of the invention mentioned above, the fastener tape is arranged so as to be hard to be viewed from the external portion or invisible by the attached body. As a result of this configuration, exposing the element rows can provide the fastener attached product with different design from conventional products and easily eliminate problems due to degradation in the appearance and design which is caused by the exposure of the fastener tapes.

In this case, since the element rows are the coil-shaped or zigzag-shaped continuous elements, and are sewn to one surface of the fastener tape, the element rows are viewed so as to be elevated largely from the tape surface and the fastener tape is hard to be viewed from between the elements. Therefore, it is possible to improve the appearance of the fastener attached product.

Particularly, in the invention, it is possible to provide the fastener attached product which is excellent in the design, by making the fastener tape invisible or hard to be viewed, and setting the colors of the attached body and the element or the colors of the attached body, the element and the sewing thread sewing the element to different colors.

Further, in the fastener attached product of the invention, the attached body has a fastener attaching portion to which a slide fastener is sewn, a bent section which extends in a width direction from the fastener attaching portion and is bent in a U-shape, and a main body portion which extends in a width direction from the bent section and is exposed to an external portion by one surface, and the slide fastener is sewn only to the fastener attaching portion of the attached body.

In this way, the fastener attached product in which the slide fastener is sewn only to the fastener attaching portion of the attached body can further improve the appearance of the fastener attached product, since the slide fastener is stably sewn to the attached body and the sewing line formed by the sewing thread is not exposed to the exposed surface side of the attached body.

Further, in the fastener attached product of the invention, the right and left sewing lines sewing the attached body and the fastener tape are arranged in outer sides of the right and left flanges of the slider. In accordance with this, even if the element rows of the fastener stringer and the U-shaped bent section of the attached body are arranged to be close to or contact with each other, it is possible to make a reduction of a sliding performance of the slider hard to be caused.

In this case, the distance between the sewing lines and the element rows can be set at equal to or more than 0.2 mm and equal to or less than 1.6 mm. It is possible to smoothly carry out the sewing of the fastener tape and the attached body by setting the distance between the sewing lines and the element rows to be equal to or more than 0.2 mm. In accordance with this, it is possible to prevent any trouble from being generated in the thread tightening of the sewing thread at a time of sewing the fastener stringer to the attached body, as mentioned above, and it is possible to prevent the sewing thread from being damaged by coming into contact with the element rows at a time when the sewing machine needle is thrust. Further, the sliding performance of the slider is not significantly lowered.

On the other hand, by setting the distance between the sewing lines and the element rows to be equal to or less than 1.6 mm, it is possible to make the fastener tape harder to be viewed or invisible from between the element rows and the U-shaped bent section of the attached body. Further, it is possible to make it hard for the puckering to be generated in the fastener stringer and the attached body.

Further, in the invention, the distance between the sewing line and the flange of the slider can be set at equal to or more than 0.1 mm and equal to or less than 1.0 mm. It is possible to secure a smooth sliding motion of the slider by setting the distance between the sewing line and the flange of the slider to be equal to or more than 0.1 mm. On the other hand, since it is possible to make the fastener tape harder to be viewed or invisible by setting the distance between the sewing line and the flange of the slider to be equal to or less than 1.0 mm, it is possible to prevent the appearance of the attached product from becoming poor and the design thereof from being degraded.

Next, in the sewing machine foot in accordance with the invention, the element guide groove which can insert the element rows is formed along the conveying direction of the fastener stringer. Further, the element guide groove is arranged so as to be inclined at a predetermined angle with respect to the pressing surface which presses the fastener tape. Further, the inner wall surface of the element guide groove has a support portion which can support at least one of the engagement head and the upper leg portion in the element rows.

By using the sewing machine foot of the invention mentioned above, it is possible to easily carry out the sewing of the fastener stringer and the attached body in such a manner that the element rows of the fastener stringer and the U-shaped bent section of the attached body come close to or come into contact with each other.

In this case, in the sewing machine foot, the distance in the width direction from the center axis in the sewing machine needle to the inner wall surface of the element guide groove can be set at equal to or less than 1.2 mm, preferably equal to or more than 0.2 mm and equal to or less than 1.2 mm, at a time of being installed to the sewing machine.

By setting the distance in the width direction mentioned above to be equal to or more than 0.2 mm, it is possible to prevent the sewing thread from being damaged by coming into contact with the element rows at a time when the sewing machine needle is thrust, and it is possible to prevent any trouble from being generated in the thread tightening of the sewing thread at a time of sewing the fastener stringer to the attached body.

On the other hand, by setting the distance in the width direction mentioned above to be equal to or less than 1.2 mm, it is possible to stably carry out the sewing of the fastener stringer and the attached body, in such a manner as to make the fastener tape hard to be viewed or invisible from between the element rows and the U-shaped bent section of the attached body.

MODE FOR CARRYING OUT THE INVENTION

Preferable embodiments of the invention will be described in detail below with reference to examples and the drawings. The invention is not limited to the embodiments described below, but can be variously changed as long as they have substantially the same structure as the invention and achieve the same operational effects.

For example, in the following embodiments, the description is given of the case that a coil-shaped element corresponding to a continuous element is sewn as element rows to a fastener tape, however, the invention is not limited to this, but can employ a zigzag-shaped element as the continuous element instead of the coil-shaped element. Further, the element rows may be constructed by a plurality of elements of a synthetic resin material which is fixed to a fastener tape by an injection molding, instead of the continuous element. Further, in the following embodiments, the description is given of the case that a fastener attached product is a seat cover for a motor vehicle, however, the invention can also be applied in the same manner to the other fastener attached products.

Figure 1:
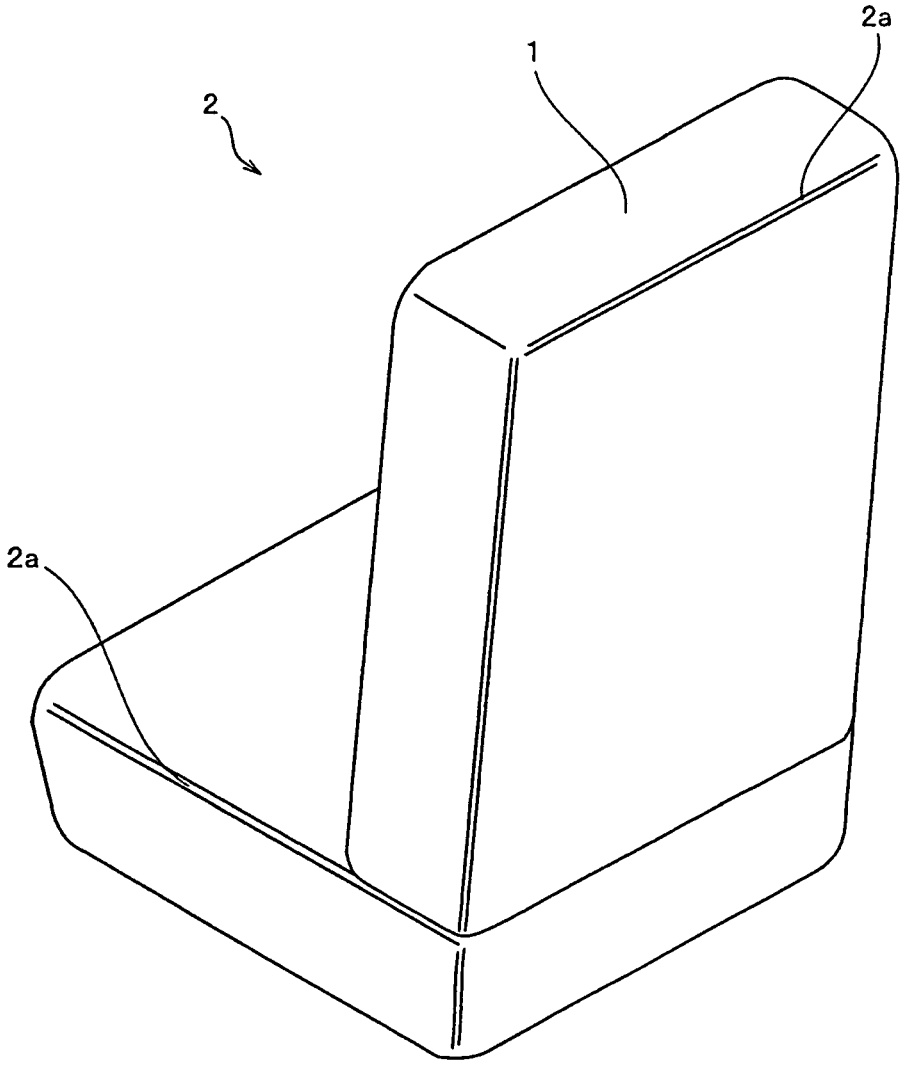
FIG. 1 is a perspective view showing a seat cover for a motor vehicle which is one of manners of use of a fastener attached product in accordance with the invention.
Figure 2:
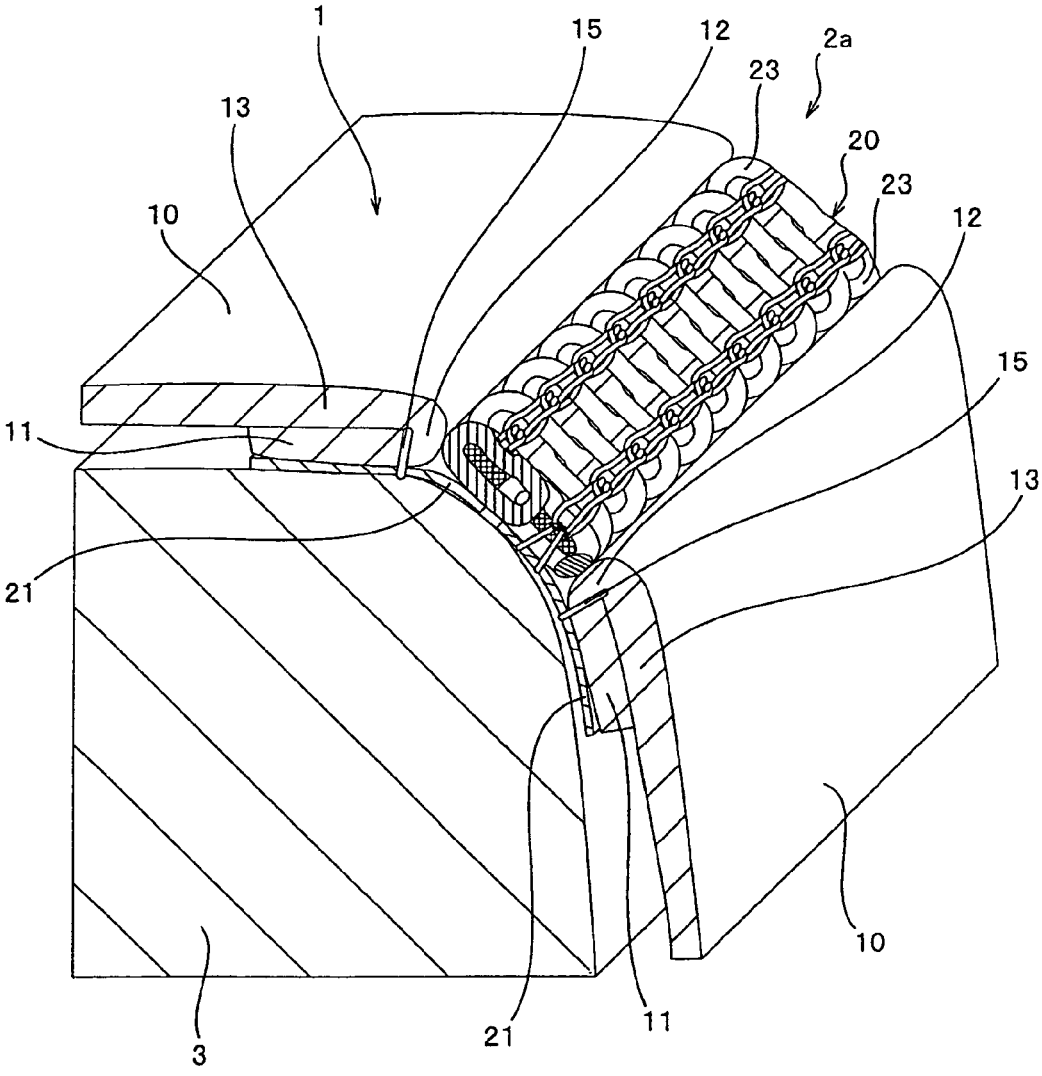
FIG. 2 is a cross-sectional perspective view showing a cross section in a substantial part of the seat cover in an enlarged manner.
Figure 3:
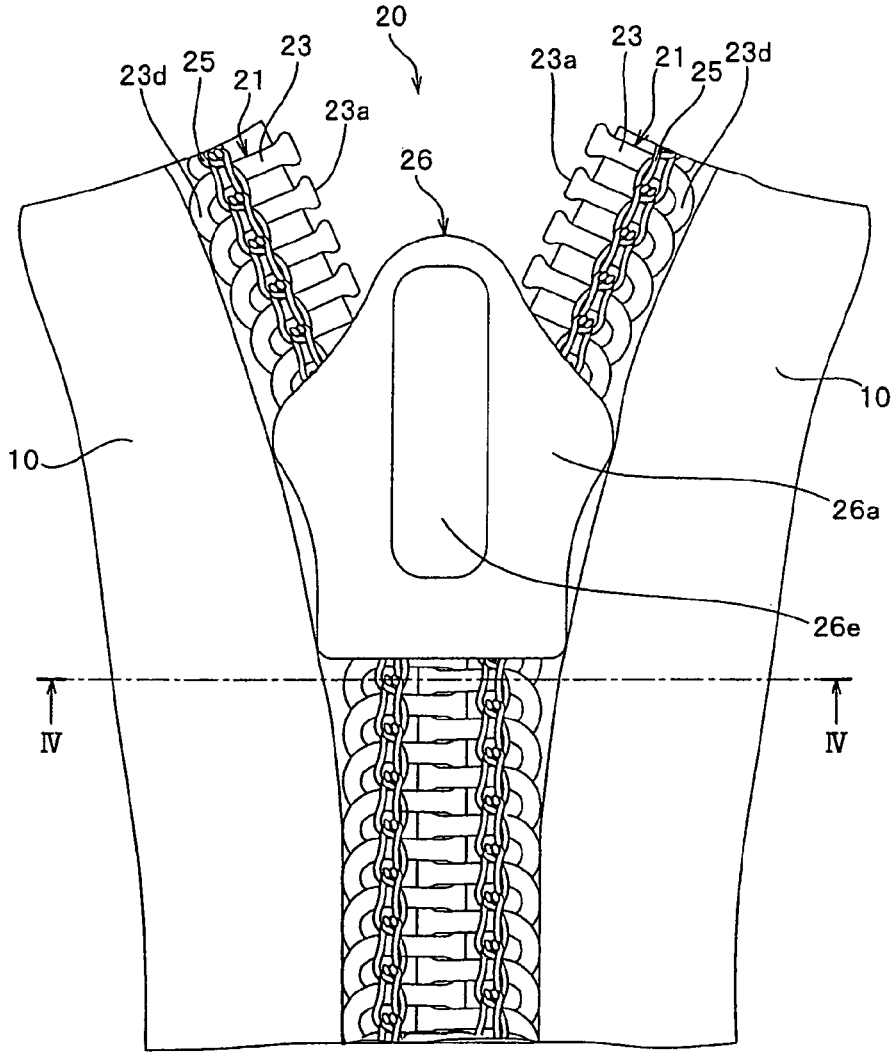
FIG. 3 is an enlarged view of a substantial part showing a slide fastener which is attached to the seat cover in an enlarged manner.
Figure 4:
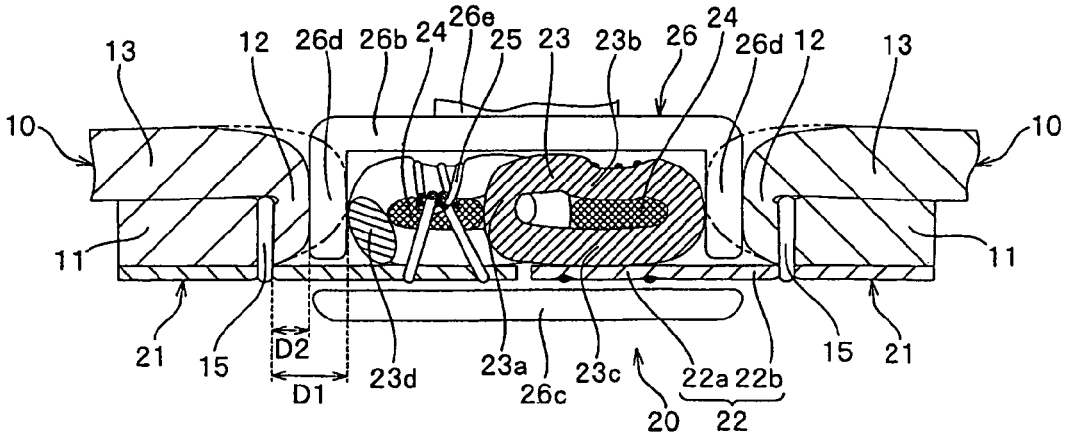
FIG. 4 is a cross-sectional view in a line IV-IV shown in FIG. 3.
Figure 5:
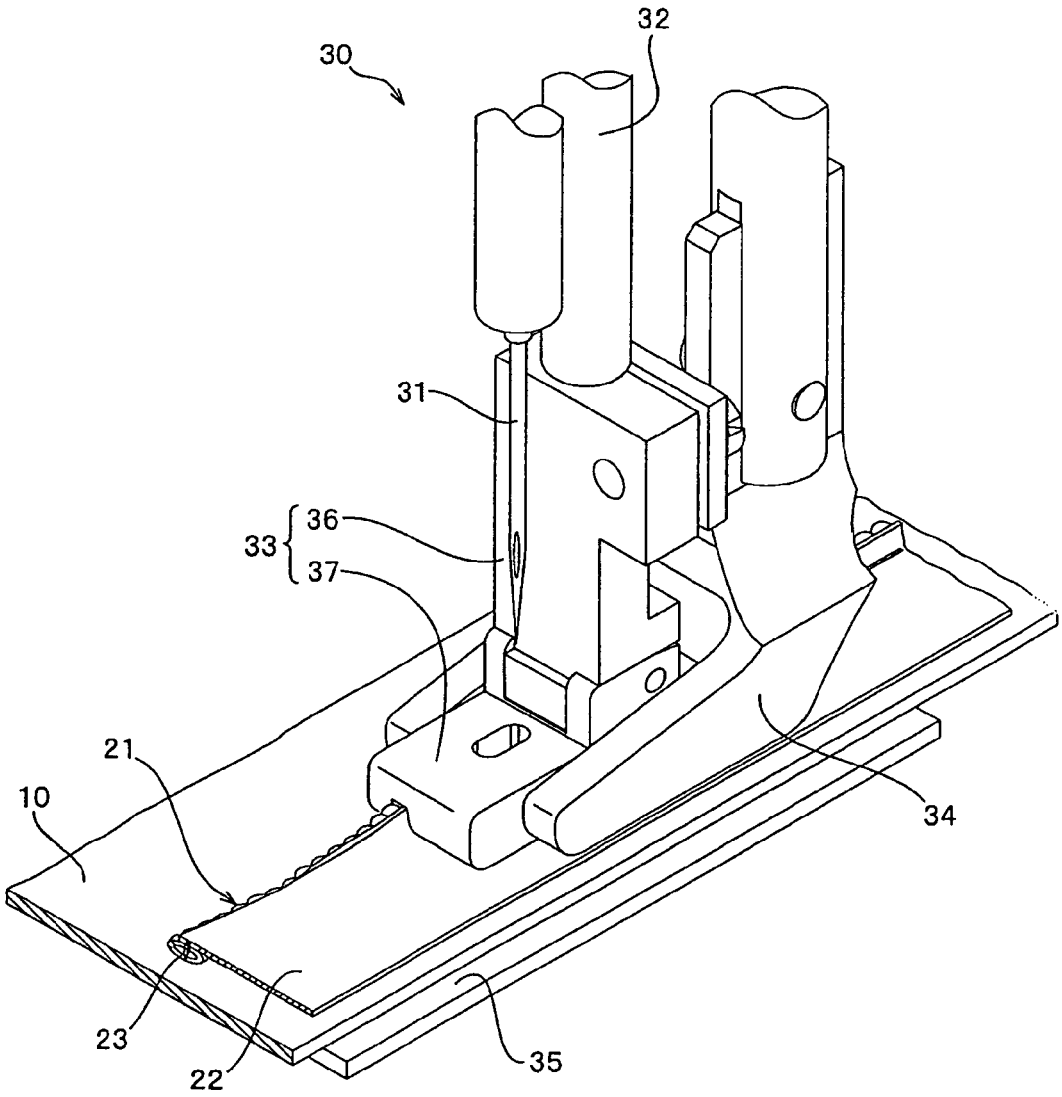
FIG. 5 is a perspective view of a substantial part showing the vicinity of a needle position in a sewing machine which is equipped with a sewing machine foot in accordance with the invention in an enlarged manner.

Note that, FIG. 1 is a perspective view showing a seat cover for a motor vehicle as the fastener attached product in the present embodiment. FIG. 2 is a cross-sectional perspective view showing a cross section in a substantial part of the seat cover in an enlarged manner. Further, FIG. 3 is an enlarged view of a substantial part showing a slide fastener which is attached to the seat cover in an enlarged manner, and FIG. 4 is a cross-sectional view in a line IV-IV shown in FIG. 3.

A seat cover 1 for a motor vehicle in the present embodiment is structured so as to be installed by covering on a surface of a cushion body 3 of a seat 2 for a motor vehicle, and has a plurality of sheet-like skin members 10 which cover the cushion body 3, and a slide fastener 20 which corresponds to a connecting portion 23*d* member connecting between the skin members 10.

Particularly, in the seat cover 1 in the present embodiment, the slide fastener 20 is arranged at a position which corresponds to a ridge line portion 2*a* of the seat 2 for the motor vehicle, and a continuous element 23 mentioned below of the slide fastener 20 is arranged and exposed to the outside, along the ridge line portion 2*a* at which the slide fastener 20 is arranged.

In the seat cover 1 in the present embodiment, a plurality of skin members 10 which are cut in a predetermined shape are used as attached bodies to which the slide fastener 20 is attached. Each of the skin members 10 has an inner cushion layer (not shown) which is made of a foamed polyurethane with an elasticity, and a skin layer (not shown) which is arranged in an outer surface (an exposed surface) side and is made of a synthetic resin. Further, the skin member 10 is formed so as to have a thickness of equal to or more than 2 mm and equal to or less than 10 mm as a whole of the cushion layer and the skin layer. Note that, in the invention, a material, a shape, a thickness and the like of the skin member 10 which is to be the attached body are not particularly limited, but can be optionally changed as appropriate.

Further, as shown in FIG. 2, the skin member 10 to which the slide fastener 20 is attached has a fastener attaching portion 11 to which a fastener tape 22 mentioned below of the slide fastener 20 is sewn, a bent section 12 which is extended from one side edge of the fastener attaching portion 11 and is bent in a U-shape, and a main body portion 13 which is further extended from the bent section 12 and covers the cushion body 3. In this case, a part of the U-shaped bent section 12 and one surface in the main body portion 13 correspond to an external surface (an exposed surface) which is exposed to an external portion.

The slide fastener 20 which is used in the seat cover 1 has a pair of right and left fastener stringers 21, and a slider 26 which can open and close the right and left fastener stringers 21. Further, each of the right and left fastener stringers 21 is provided with a narrow band shaped fastener tape 22 which is woven or knitted and coil-shaped continuous elements (element rows) 23 which are sewn to the respective right and left fastener tapes 22.

The fastener tape 22 has a tape main body portion 22*a* which is sewn to the skin member 10 and an element attaching portion (a tape side edge portion) 22*b* which is extended from one side edge of the tape main body portion 22*a* and to which the continuous elements 23 are sewn. Further, the fastener tape 22 is not thermally set in a state in which it is bent in a U-shape, for example, a fastener tape of a concealing slide fastener or the like, at a time when the fastener stringer 21 is constructed, but is arranged in such a manner that a tape surface thereof forms the same plane. Further, even in the case that the right and left continuous elements 23 are in an engaged state in the slide fastener 20, the tape surfaces of the right and left fastener tape 20 can form the same plane.

Note that, in the case that the seat cover 1 is attached to the cushion body 3 as shown in FIG. 2, the slide fastener 20 is arranged in the ridge line portion 2*a* of the seat 2 for the motor vehicle. Accordingly, since the fastener tape 20 is easily curved in conformity to the shape of the cushion body 3 at a time when the seat cover 1 is attached to the cushion body 3, the tape surface of the fastener tape 20 naturally does not form the same plane.

The continuous element 23 constructing the element rows is formed by forming a monofilament made of a synthetic resin such as a polyester or the like as a coil shape. The continuous element 23 has an engagement head 23*a*, upper and lower leg portions 23*b* and 23*c* which are extended from the engagement head 23*a*, and a connecting portion 23*d* which connects an end portion of the upper leg portion 23*b* or the lower leg portion 23*c* to the lower leg portion 23*c* or the upper leg portion 23*b* of the adjacent fastener element.

The continuous element 23 is sewn to the element attaching portion 22*b* of the fastener tape 22 by an element sewing thread 25 in a state in which a core thread 24 is inserted between the upper and lower leg portions 23*b* and 23*c*, and the engagement head 23*a* protrudes to an outer side from a tape side edge of the fastener tape 22.

Note that, the continuous element 23 in the present embodiment is sewn to the surface of the fastener tape 22 (the surface to which the skin member 10 corresponding to the attached body is sewn), as mentioned below. In accordance with this, the continuous element 23 bulges largely with respect to the surface of the fastener tape 22.

The slider 26 used in the slide fastener 20 in the present embodiment is structured substantially in the same manner as the slider which is generally used in the slide fastener in which the conventional coil-shaped continuous element is arranged. Specifically, the slider 26 is provided with a slide body 26*a* and a tab (not shown) which is rotatably retained to the slider body 26*a*.

Further, the slider body 26*a* has upper and lower blades 26*b* and 26*c*, a connecting post (not shown) which connects the upper and lower blades 26*b* and 26*c* at their end portions and, a flange 26*d* which is provided in each of right and left side edges of the upper and lower blades 26*b* and 26*c*, and a tab attaching post 26*e* which is provided in a rising manner on a surface (an upper surface), of the upper blade 26*b*.

In the sheet cover 1 in the present embodiment mentioned above, the slide fastener 20 is sewn to the fastener attaching portion 11 by the sewing thread 15. In this case, the slide fastener 20 is sewn in such a manner that the skin member 10 is arranged on the same tape surface as the tape surface in a side in which the continuous element 23 of the fastener tape 22 is sewn. Further, since the skin member 10 is bent in a U-shape by the bent section 12, the fastener tape 22 of the slide fastener 20 is arranged in the same surface side as the exposed outer surface of the skin member 10.

Figure 10:
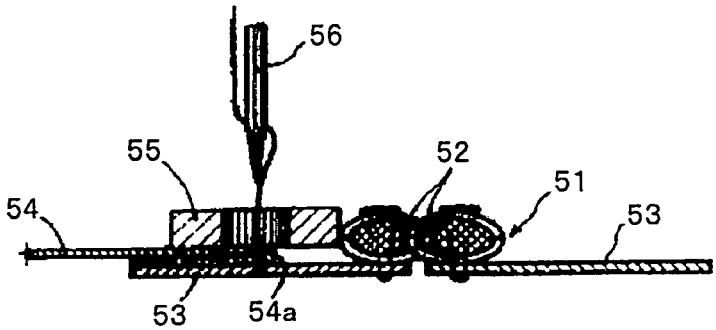
FIG. 10 is a schematic view describing a conventional sewing method for sewing an attached body to a fastener chain.

Further, the slide fastener 20 is not sewn to two portions including the fastener attaching portion and the main body portion of the attached body 54 which is bent, for example, in the Patent Document 1 (refer to FIG. 10), by the sewing thread 15, but is sewn only to the fastener attaching portion 11 of the skin member 10. In accordance with this, since the sewing line formed by the sewing thread 15 is not exposed on the outer surface (the exposed surface) of the skin member 10, it is possible to improve an appearance of the seat cover 1.

The seat cover 1 in the present embodiment having the skin member 10 and the slide fastener 20 as mentioned above is structured such that the continuous element 23 is exposed between the right and left skin members 10 which are arranged in both sides of the slide fastener 20, particularly between the U-shaped bent sections 12 of the skin member 10, at a time of closing the slide fastener 20 by engaging the right and left continuous elements 23.

Further, the slide fastener 20 is attached between the right and left skin members 10 in such a manner that the U-shaped bent section 12 of the skin member 10 comes into contact with the outer surfaces of the right and left flanges 26*d* of the slider 26. Particularly, in the case of the present embodiment, the slide fastener 20 is attached to the skin member 10 in such a manner that the U-shaped bent sections 12 of the right and left skin members 10 come into contact with the connecting portions 23*d* of the right and left continuous elements 23 in the engaged state, at a time of sliding the slider 26 so as to engage the right and left continuous elements 23.

In accordance with this, in a state in which the slide fastener 20 is closed, it is possible to respectively cover over the right and left fastener tapes 22 of the slide fastener 20 by the right and left skin members 10. In accordance with this, it is possible to expose the engaged continuous element 23 between the skin members 10, and on the other hand, it is possible to make the fastener tape 22 invisible (or hard to be viewed) at a time of viewing the seat cover 1 from the outer surface side.

On the other hand, in the case that the seat cover 1 is structured such that the U-shaped bent section 12 of the skin member 10 comes into contact with the outer surface of the right and left flanges 26*d* of the slider 26 as mentioned above, if a friction force generated between the skin member 10 and the slider 26 becomes too large, it causes a sliding performance of the slider 26 to be lowered.

In accordance with this, in the present embodiment, in order to reduce an influence which the friction force between the skin member 10 and the slider 26 has on the sliding performance of the slider 26, the positions of the right and left sewing lines (the sewing threads 15) sewing the skin member 10 and the fastener tape 22 are set to an outer side than the positions of the right and left flanges 26*d* of the slider 26 in a tape width direction of the fastener tape 22. In accordance with this, even in the case that the seat cover 1 is structured such that the U-shaped bent section 12 of the skin member 10 comes into contact with the connecting portion 23*d* of the continuous element 23 as in the present embodiment, the sliding performance of the slider 26 is not largely lowered, but it is possible to smoothly slide the slider 26 while elastically deforming the bent section 12 of the skin member 10 as shown in FIG. 4.

In this case, the position of the sewing line (the sewing thread 15) is set such that the distance (the dimension) D1 in the tape width direction between the sewing line and the continuous element 23 is equal to or more than 0.2 mm and equal to or less than 1.6 mm, preferably equal to or more than 0.5 mm and equal to or less than 1.0 mm.

It is possible to secure a stable sliding performance of the slider 26 by setting the distance D1 between the sewing line and the connecting portion 23*d* of the continuous element 23 to be equal to or more than 0.2 mm (preferably equal to or more than 0.5 mm). Further, it is possible to smoothly thrust a sewing machine needle 31 to the fastener tape 22 and the skin member 10 without interfering with the continuous element 23, at a time of sewing the fastener stringer 21 to the skin member 10 by using a sewing machine 30 (a detailed description will be given later). Therefore, it is possible to firmly sew the continuous element 23 while stably performing a sewing process at the same time preventing the sewing thread 15 from being damaged.

Further, it is possible to make a dimension between the continuous element 23 and the U-shaped bent section 12 of the skin member 10 smaller by setting the distance D1 between the sewing line and the connecting portion 23*d* of the continuous element 23 to be equal to or less than 1.6 mm (preferably equal to or less than 1.0 mm), whereby it is possible to effectively conceal the fastener tape 22.

Further, it is possible to arrange the sewing line at a closer position of the continuous element 23, by making the distance D1 equal to or less than 1.6 mm. In accordance with this, it is possible to inhibit the skin member 10 and the fastener stringer 21 from contracting in a length direction thereof by utilizing a rigidity of the continuous element 23. In accordance with this, it is possible to make it hard for a puckering (a wavy wrinkle) to be generated in the seat cover 1, at a time of sewing the fastener stringer 21 to the skin member 10.

Further, in the present embodiment, the position of the sewing line is set such that a distance (a dimension) D2 between the sewing line and the flange 26*d* of the slider 26 becomes equal to or more than 0.1 mm and equal to or less than 1.0 mm. It is possible to more smoothly slide the slider 26 by setting the distance D2 between the sewing line and the flange 26*d* to be equal to or more than 0.1 mm.

On the other hand, it is possible to securely bring the skin member 10 into contact with the flange 26*d* of the slider 26 by setting the distance D2 between the sewing line and the flange 26*d* to be equal to or less than 1.0 mm, whereby it is possible to effectively conceal the fastener tape 22. Note that, in the present embodiment, the distance D1 in the tape width direction between the sewing line and the continuous element 23 is set to be smaller than a sum of a thickness of the skin member 10 (particularly, a thickness of the U-shaped bent section 12) and a dimension in a width direction of the flange 26*d* of the slider 26.

Next, a description will be given of a method of manufacturing the seat cover 1 in the present embodiment.

First of all, one fastener stringer 21 in the slide fastener 20 is sewn to one skin member 10 by using the sewing machine 30. Hence, a description will be given of the sewing machine 30 which performs the sewing of the fastener stringer 21 and the skin member 10, with reference to FIGS. 5 to 9.

Note that, in the following description of the sewing machine 30, a direction in which the sewing machine needle 31 is thrust to the sewn subject (the fastener stringer 21 and the skin member 10) is defined as a downward direction, and a direction in which the sewing machine needle 31 is drawn out of the sewn subject is defined as an upward direction. Further, a direction in which the sewn subject is conveyed is defined as a rearward direction, and an opposite direction thereto is defined as a forward direction. Further, a direction which is orthogonal to an up and down direction and a back and forth direction is defined as a lateral direction (or a width direction).

The sewing machine 30 used in the present embodiment has the sewing machine needle 31 which is installed so as to be movable in the up and down direction and the back and forth direction, a presser bar 32 which moves in conjunction with a movement of the sewing machine needle 31, a sewing machine foot (an inner pressing portion) 33 which is arranged in a lower end of the presser bar 32 and presses the sewn subject from the above, an outer pressing portion 34 which can press the sewn subject from the above instead of the sewing machine foot 33 at a time when the sewing machine foot 33 is held up, a throat plate 35 which mounts the sewn subject, and a downward convey portion (not shown) which is arranged within an opening (not shown) formed in the throat plate 35.

This sewing machine 30 can press the sewn subject by the sewing machine foot 33 and the downward convey portion (not shown) and can convey the sewn subject rearward together with the sewing machine needle 31, in a state in which the sewing machine needle 31 is thrust to the sewn subject. Further, the sewing machine 30 is structured as a so-called general convey sewing machine in which the outer pressing portion 34 can press the sewn subject at a time when the sewing machine foot 33 and the downward convey portion (not shown) move forward.

Further, the sewing machine foot 33 installed to the sewing machine 30 has a fixed portion 36 which is fixed to the presser bar 32, a foot main body 37 which is axially attached to the fixed portion 36 so as to freely oscillate in the up and down direction, and a resilient member (not shown) which energizes the foot main body 37 so as to incline downward toward a leading end.

Figure 6:
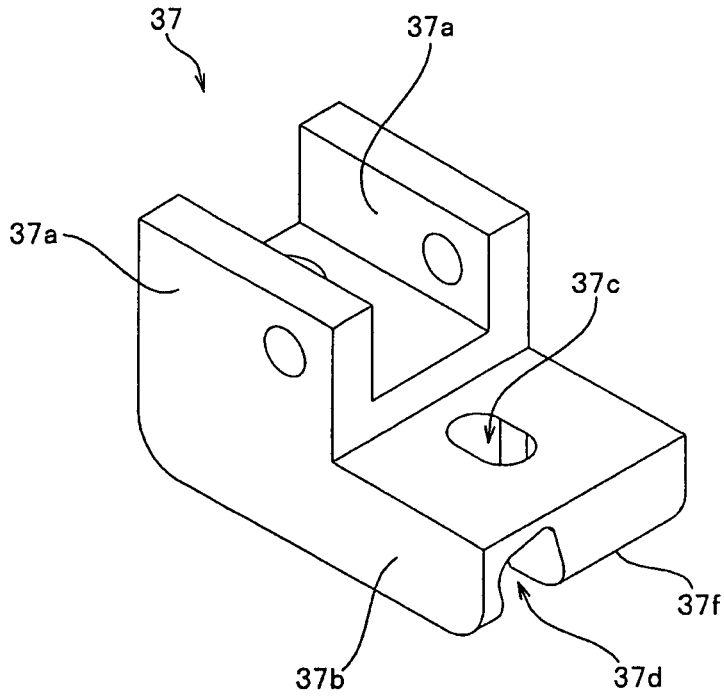
FIG. 6 is a perspective view in which the sewing machine foot is viewed from a diagonally upward direction.
Figure 7:
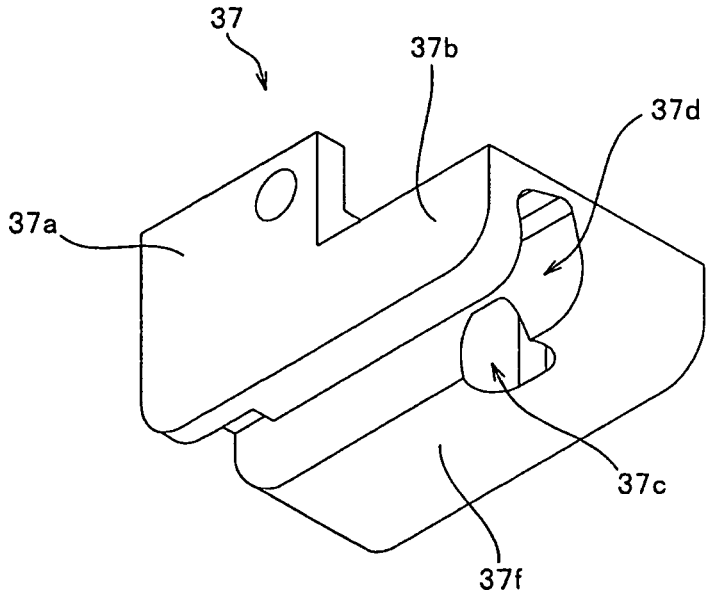
FIG. 7 is a perspective view in which the sewing machine foot is viewed from a diagonally downward direction.
Figure 8:
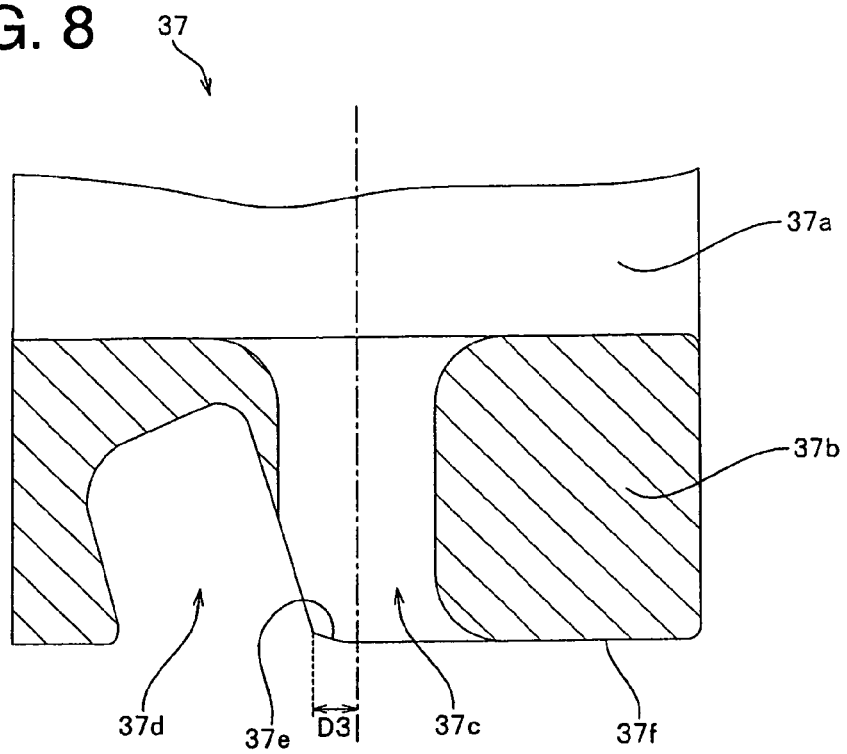
FIG. 8 is a cross-sectional view of the sewing machine foot.

As shown in FIGS. 6 to 8, the foot main body 37 in the sewing machine foot 33 is formed as an substantially L-shaped form and has abase end portion 37*a* which is axially attached to the fixed portion 36 and a pressing portion 37*b* which is arranged in a lower end of the base end portion 37*a*. Further, in the pressing portion 37*b* of the foot main body 37, there is formed a needle hole 37*c* which passes through in the up and down direction (the thrusting direction of the sewing machine needle 31) and can allow the sewing machine needle 31 to be inserted.

Further, in the pressing portion 37*b*, there is formed an element guide groove 37*d* which can insert the continuous element 23 of the fastener stringer 21 and a part of the fastener tape 22. In this case, the element guide groove 37*d* is arranged along a conveying direction of the fastener stringer 21 and the skin member 10 which are conveyed by the sewing machine 30, and also a chamfer portion 37*e* is formed in a lower end portion of the element guide groove 37*d*.

Further, in an inner wall surface of the element guide groove 37*d*, there is arranged a support surface (a support portion) which can support the continuous element 23, particularly support at least one of the engagement head 23*a* and the upper leg portion 23*b* of the continuous element 23, and can maintain a state in which the continuous element 23 arises and inclines, at a time of inserting the continuous element 23 and a part of the fastener tape 22.

Note that, the inner wall surface of the element guide groove 37*d* has first and second side surface portions which are formed in a depth direction (a left diagonally upward direction) of the element guide groove 37*d* from a bottom surface 37*f* and an upper surface portion which is formed in a bottom portion side of the element guide groove 37*d*. In this case, the first side surface portion is arranged in a side of the needle hole 37*c* of the element guide groove 37*d*. The second side surface portion is arranged in an opposite side to the needle hole 37*c* of the element guide groove 37*d*, and is opposed to the first side surface portion. The upper surface portion is arranged in such a manner as to connect the first side surface portion and the second side surface portion. Therefore, the second side surface portion of the element guide groove 37*d* corresponds to the support surface (the support portion) which supports the continuous element 23.

Further, the element guide groove 37*d* in the present embodiment is formed so as to be inclined at an angle of equal to or more than 65 degrees and equal to or less than 80 degrees with respect to the bottom surface 37*f* which corresponds to the pressing surface of the pressing portion 37*b*. Note that, an angle of incline of the element guide groove 37*d* the herein means an angle of the inner wall surface of the needle hole 37*c* side in the element guide groove 37*d* with respect to the bottom surface 37*f* of the pressing portion 37*b* or the inner wall surface of the outer side (the opposite side to the needle hole 37*c* side), and the angle of incline of at least one inner wall surface should be set within the range mentioned above.

By setting the angle of incline of the element guide groove 37*d* to be equal to or more than 65 degrees, it is possible to easily sew the fastener tape 22 and the skin member 10 while thrusting the sewing machine needle 31 to the position in the vicinity of the connecting portion 23*d* of the continuous element 23 without making the continuous element 23 be interfered with the skin member 10, at a time of sewing the fastener stringer 21 to the skin member 10. Further, by setting the angle of incline of the element guide groove 37*d* to be equal to or less than 80 degrees, it is possible to smoothly insert the continuous element 23 and a part of the fastener tape 22 into the element guide groove 37*d* while preventing the element guide groove 37*d* from being completely integrated with the needle hole 37*c*.

Further, a distance (a dimension) D3 in a lateral direction between the inner wall surface (except the chamfer portion 37*e*) of the needle hole 37*c* side in the element guide groove 37*d* and the center axis of the sewing machine needle 31 is set to be equal to or less than 1.2 mm, preferably equal to or more than 0.2 mm and equal to or less than 1.2 mm, and more preferably equal to or more than 0.5 mm and equal to or less than 1.0 mm.

By setting the distance D3 between the inner wall surface of the element guide groove 37*d* and the center axis of the sewing machine needle 31 to be equal to or more than 0.2 mm, it is possible to prevent the sewing machine needle 31 and the sewing thread 15 from coming into contact with the continuous element 23, at a time when the sewing needle 31 thrusts the fastener tape 22 and the skin member 10. Therefore, it is possible to prevent the sewing thread 15 from being damaged from the continuous element 23 at a time of sewing, and also it is possible to prevent the thread tightening of the sewing thread 15 from being troubled at a time of sewing the fastener stringer 21 to the skin member 10.

On the other hand, by setting the distance D3 between the inner wall surface of the element guide groove 37*d* and the center axis of the sewing machine needle 31 equal to or less than 1.2 mm, it is possible to easily make the distance D1 between the sewing line and the continuous element 23 equal to or less than 1.6 mm, at a time of sewing the fastener stringer 21 to the skin member 10.

Accordingly, as mentioned above, it is possible to make the distance between the continuous element 23 and the U-shaped bent section 12 of the skin member 10 small (or zero) at a time of sewing the fastener stringer 21, whereby making the fastener tape 22 hard to be viewed from the outer surface side. In addition, it is possible to make it hard for the puckering to be generated in the skin member 10 and the fastener stringer 21.

Then, in the case of sewing the fastener stringer 21 and the skin member 10 by using the sewing machine 30 as mentioned above, to begin with, the fastener stringer 21 is superposed on the skin member 10 first of all by aligning the tape surface of the side to which the continuous element 23 is sewn of the fastener tape 22, with the surface of the side which corresponds to the outer surface exposed to the outer portion of the skin member 10. At this time, the continuous element 23 comes to a state of being arranged between the fastener tape 22 and the skin member 10.

Further, in a state in which the fastener stringer 21 is superposed on the skin member 10, the fastener stringer 21 and the skin member 10 are mounted on the throat plate 35 of the sewing machine 30 so as to be conveyed toward the sewing machine foot 33. In this case, at a time of starting the sewing by the sewing machine 30, in one end portion (a rear end portion) in the tape length direction of the fastener stringer 21, the tape main body portion 22*a* of the fastener tape 22 is pressed by the bottom surface 37*f* of the sewing machine foot 33, and the continuous element 23 and the element attaching portion 22*b* of the fastener tape 22 are introduced into the element guide groove 37*d* of the sewing machine foot 33, while bending the fastener tape 22.

Subsequently, the fastener stringer 21 and the skin member 10 are conveyed rearward sequentially by the sewing machine foot 33 and the downward convey portion (not shown), in a state in which the rear end portion of the fastener stringer 21 is retained as mentioned above. In accordance with this, the continuous element 23 and the element attaching portion 22*b* are guided to the element guide groove 37*d* while bending the fastener tape 22 to the opposite side to the side of the skin member 10 so as to be sequentially inclined in a direction in which the engagement head 23*a* of the continuous element 23 arises, in proportion to the continuous element 23 and the element attaching portion 22*b* which are introduced into the element guide groove 37*d* precedingly.

Figure 9:
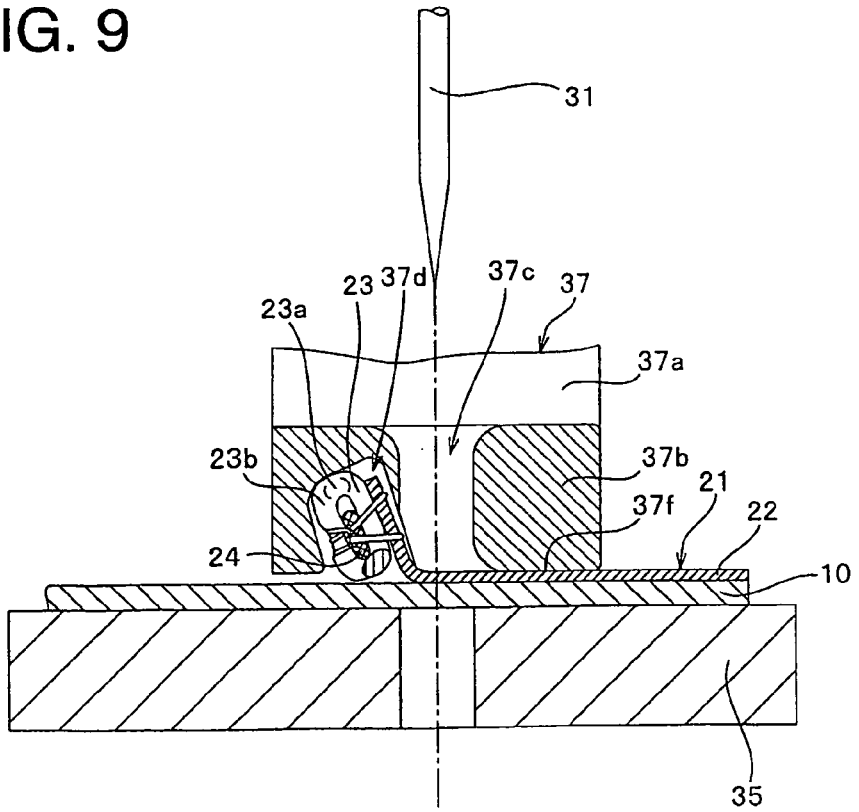
FIG. 9 is a cross-sectional view schematically showing a state of a sewing machine foot, a fastener stringer and an attached body at a time of sewing.

In this way, by the continuous element 23 and the element attaching portion 22*b* being guided to the element guide groove 37*d*, as shown in FIG. 9, it is possible to make the distance in the width direction from the center axis of the sewing machine needle 31 to the position at which the fastener 22 is bent (the bending base end position) equal to or less than 1.2 mm, preferably equal to or more than 0.2 mm and equal to or less than 1.2 mm, and it is possible to make the bending angle of the fastener tape 22 with respect to the bottom surface 37*f* of the sewing machine foot 33 equal to or more than 65 degrees and equal to or less than 80 degrees.

Note that, when the continuous element 23 and the element attaching portion 22*b* are guided to the element guide groove 37*d* and are inserted into the element guide groove 37*d*, the tape main body portion 22*a* of the fastener tape 22 is pressed by the bottom surface 37*f* of the sewing machine foot 33, and at least one of the engagement head 23*a* and the upper leg portion 23*b* in the continuous element 23 is supported by the inner wall surface of the element guide groove 37*d*. In accordance with this, the fastener tape 22 is sequentially conveyed rearward while maintaining a state in which it is bent at a predetermined angle.

Note that, in this case, in order to make the friction force between the sewing machine foot 33 and the fastener stringer 21 small at a time of inserting the fastener stringer 21 into the element guide groove 37*d*, the element guide groove 37*d* is preferably formed such that a gap is provided between the element attaching portion 22*b* of the fastener tape 22 and the inner wall surface of the needle hole 37*c* side of the element guide groove 37*d* (refer to FIG. 9).

Then, the fastener stringer 21 and the skin member 10 are conveyed rearward while inserting the continuous element 23 and the element attaching portion 22*b* into the element guide groove 37*d*, and the sewing machine needle 31 is reciprocated in the up and down direction while being aligned with the conveying motion of the fastener stringer 21 and the skin member 10. In accordance with this, it is possible to sew the fastener tape 22 to the skin member 10 at the position in the vicinity of the connecting portion 23*d* of the continuous element 23.

Note that, in the case that the fastener stringer 21 and the skin member 10 are conveyed on the throat plate 35 after the fastener tape 22 is sewn to the skin member 10, the continuous element 23 is interfered with the skin member 10 at the same time of being retained by the element attaching portion 22*b* of the fastener tape 22. Therefore, the engagement head 23*a* is maintained in a state in which it is inclined in the direction of raising at a predetermined angle.

After the fastener stringer 21 is sewn to the skin member 10 over a whole in the length direction as mentioned above, the skin member 10 is bent in a U-shape toward an opposite side to the side to which the fastener stringer 21 is sewn, along the sewing line which is formed by the sewing thread 15. Thereafter, in order to maintain the bent state of the skin member 10, a thermal set is further applied to the skin member 10 as appropriate.

In accordance with this, the bent state of the fastener tape 22 is released, the fastener tape 22 is retained in a straight state, and the connecting portion 23*d* of the continuous element 23 and the bent section 12 bent in a U-shape of the skin member 10 come to a state in which they are in contact with or close to each other.

Thereafter, the fastener stringer 21 is sewn as mentioned above, the right and left U-shaped bent skin members 10 are combined as one set, and the slider 26 is slidably attached along the continuous element 23 of the combined fastener stringer 21. In accordance with this, the seat cover 1 mentioned above in the present embodiment shown in FIGS. 1 to 4 can be obtained.

The seat cover 1 in the present embodiment obtained thereby can clearly expose the continuous element 23 in the engaged state between the right and left skin members 10 to the outer surface (the exposed surface) side, at a time of engaging the right and left continuous elements 23 by sliding the slider 26.

Further, by the distance D1 between the sewing line which sews the fastener tape 22 and the skin member 10 and connecting portion 23*d* of the continuous element 23 being set to be equal to or more than 0.2 mm and equal to or less than 1.6 mm, preferably equal to or more than 0.2 mm and equal to or less than 1.2 mm, and more preferably equal to or more than 0.5 mm and equal to or less than 1.0 mm, it is possible to bring the U-shaped bent section 12 in the right and left skin members 10 into contact with the outer surface of the right and left flanges 26*d* in the slider 26, and further bring the U-shaped bent section 12 in the right and left skin members 10 into contact with the connecting portion 23*d* of the continuous element 23 (refer to FIG. 4).

In accordance with this, it is possible to make the right and left fastener tapes 22 hard to be viewed from the outer surface side or invisible between the right and left skin members 10, while exposing the continuous element 23 between the right and left skin members 10. Further, the seat cover 1 in the present embodiment can conceal the sewing line which sews the fastener tape 22 and the skin member 10, from the external portion by the skin member 10.

Accordingly, since the seat cover 1 in the present embodiment can provide with a new design by exposing the continuous element 23 to the outer surface, and can prevent degradation in the appearance and design which is caused by the exposure of the fastener tape 22 and the sewing line, it is possible to provide, as an example, a commercial value which has not been provided conventionally to the seat 2 for the motor vehicle.

Note that, in the present embodiment, in the case that the fastener stringer 21 is sewn to the skin member 10, the sewing of the fastener stringer 21 and the skin member 10 is carried out by installing the sewing machine foot 33 of the invention to the general convey sewing machine 30 as mentioned above. However, the invention is not limited to this, but the sewing of the fastener stringer 21 and the skin member 10 can be performed, for example, by installing the sewing machine foot 33 of the invention to a sewing machine which is so-called an up and down convey sewing machine.

DESCRIPTION OF REFERENCE NUMERALS

1 seat cover
2 seat for motor vehicle
2*a* ridge line portion
3 cushion body
10 skin member
11 fastener attaching portion
12 bent section
13 main body portion
15 sewing thread
20 slide fastener
21 fastener stringer
22 fastener tape
22*a* tape main body portion
22*b* element attaching portion (tape side edge portion)
23 continuous element (element rows)
23*a* engagement head
23*b* upper leg portion
23*c* lower leg portion
23*d* connecting portion
24 core thread
25 element sewing thread
26 slider
26*a* slider body
26*b* upper blade
26*c* lower blade
26*d* flange
26*e* tab attaching post
30 sewing machine
31 sewing machine needle
32 presser bar
33 sewing machine foot
34 outer pressing portion
35 throat plate
36 fixed portion
37 foot main body
37*a* base end portion
37*b* pressing portion
37*c* needle hole
37*d* element guide groove
37*e* chamfer portion
37*f* bottom surface
D1 distance between sewing line and continuous element
D2 distance between sewing line and flange of slider
D3 distance between element guide groove and center axis of sewing machine needle

The invention claimed is:

1. A method of sewing a fastener stringer having a fastener tape in which a tape surface is arranged on the same plane, and element rows which are attached to a tape side edge portion of the fastener tape, and sews a fastener stringer in which an engagement head in the element rows protrudes out of a tape end edge of the fastener tape, with respect to an attached body by using a sewing machine, wherein the sewing machine has a sewing machine foot which is provided with an element guide groove capable of inserting the element rows and a part of the fastener tape; and wherein at a time of sewing the fastener stringer, the method includes the steps of:

conveying the fastener stringer and the attached body toward the sewing machine foot in a state of aligning a tape surface of a side to which the element rows of the fastener tape are attached, with one surface corresponding to a side which is exposed to an external portion of the attached body so as to superpose the fastener stringer on the attached body;

guiding the element rows to the element guide groove of the sewing machine foot while bending the fastener tape in such a manner that the engagement head of the element rows rises; and sewing the fastener tape to the attached body while inserting the element rows and a part of the fastener tape in to the element guide groove of the sewing machine foot.

2. The method of sewing a fastener stringer according to claim 1, wherein the method include the step of using a fastener stringer in which the element rows are sewn to one surface of the fastener tape, wherein the element rows are coil-shaped or zigzag-shaped continuous elements, as the fastener stringer.

3. The method of sewing a fastener stringer according to claim 1, wherein the method includes the step of setting a distance in a width direction from a center axis in a sewing machine needle of the sewing machine to a position of a bent base end of the fastener tape to be equal to or less than 1.2 mm, at a time when the element rows travel within the element guide groove of the sewing machine foot.

4. The method of sewing a fastener stringer according to claim 1, wherein the element guide groove is inclined at a predetermined angle with respect to a bottom surface corresponding to a pressing surface of the sewing machine foot, and is arranged along a direction of conveying the fastener stringer, and wherein a bending angle of the fastener tape with respect to the bottom surface of the sewing machine foot is set to be equal to or more than 65 degrees and equal to or less than 80 degrees at a time when the element rows travel within the element guide groove of the sewing machine foot.

5. A method of manufacturing a product to which a fastener is attached, wherein the method includes at least the step of bending the attached body to which the fastener stringer is sewn by the method of sewing the fastener stringer according to claim 1 in a U-shape toward an opposite side to the fastener stringer side along a sewing line, and the step of constructing a slide fastener by attaching a slider to a pair of right and left fastener stringers, thereby manufacturing the fastener attached product in which the slide fastener is attached to the attached body.

6. A product to which a fastener is attached, wherein the product is manufactured by the method of manufacturing the product to which fastener is attached according to claim 5.

* * * * *

UNITED STATES PATENT AND TRADEMARK OFFICE

CERTIFICATE OF CORRECTION

PATENT NO. : 8,910,583 B2
APPLICATION NO. : 13/515357
DATED : December 16, 2014
INVENTOR(S) : Haruo Matsushima et al.

It is certified that error appears in the above-identified patent and that said Letters Patent is hereby corrected as shown below:

In the Specification

In column 5, line 23, delete “is,” and insert -- is --, therefor.

In column 6, line 10, delete “sheet-like” and insert -- seat-like --, therefor.

In column 6, line 48, delete “fastener,” and insert -- fastener --, therefor.

In column 11, line 34, delete “sheet-like” and insert -- seat-like --, therefor.

In column 12, line 67, delete “surface),” and insert -- surface) --, therefor.

In column 13, line 1, delete “sheet” and insert -- seat --, therefor.

In column 15, line 42, delete “abase” and insert -- a base --, therefor.

Signed and Sealed this
Twenty-eighth Day of April, 2015

Michelle K. Lee

Michelle K. Lee
*Director of the United States Patent and Trademark Office*